US007044035B2

(12) United States Patent
Pregeant

(10) Patent No.: US 7,044,035 B2
(45) Date of Patent: May 16, 2006

(54) HAMMER WRENCH ASSEMBLY AND METHOD OF USE

(76) Inventor: Mark Pregeant, 18838 Highway 3235, Galliano, LA (US) 70354

( * ) Notice: Subject to any disclaimer, the term of this patent is extended or adjusted under 35 U.S.C. 154(b) by 0 days.

(21) Appl. No.: 10/613,928

(22) Filed: Jul. 3, 2003

(65) Prior Publication Data

US 2005/0000329 A1 Jan. 6, 2005

(51) Int. Cl.
*B25B 19/00* (2006.01)

(52) U.S. Cl. ..... 81/466; 81/177.2; 81/124.3

(58) Field of Classification Search ..... 81/177.2, 81/124.3, 124.7, 124.6, 465, 466, DIG. 8
See application file for complete search history.

(56) References Cited

U.S. PATENT DOCUMENTS

| | | | | |
|---|---|---|---|---|
| 271,549 | A | 1/1883 | True | |
| 291,961 | A | 1/1884 | True | |
| 496,913 | A * | 5/1893 | Shoe | 81/124.3 |
| 1,710,198 | A | 4/1929 | Torgerson | |
| 2,600,796 | A | 6/1952 | Nash | |
| 2,978,938 | A * | 4/1961 | Nalley | 81/177.2 |
| 3,799,011 | A | 3/1974 | Davis, Jr. | |
| 4,628,776 | A * | 12/1986 | Witbeck | 81/466 |
| 4,759,242 | A * | 7/1988 | Andersson | 81/466 |
| 4,811,638 | A * | 3/1989 | Kertzscher | 81/177.2 |
| 4,864,902 | A | 9/1989 | Doorley | |
| 5,062,327 | A * | 11/1991 | Hammons et al. | 81/124.3 |

* cited by examiner

*Primary Examiner*—Lee D. Wilson
*Assistant Examiner*—Alvin J. Grant
(74) *Attorney, Agent, or Firm*—Raymond G. Areaux; Lisa C. Velez

(57) ABSTRACT

A hammer wrench assembly and method of use that includes a safety handle for use with a hammer wrench. The hammer wrench is fitted with a female coupling. The safety handle is fitted with a male coupling adapted to mate with the female coupling. The male coupling is pivotally coupled to the safety handle so that the handle can be rotated up to 180°. The hammer wrench assembly can be used by one user or two users. With two users, one user can swing the hammer while the other use can steady the hammer wrench with the safety handle.

8 Claims, 3 Drawing Sheets

10
44
46
42
40
48
52
50
56
48a
54
22
28a
20
26
34
26a
24

22
20'
30
26a'
32
24'

22
20'
26a'
34
24'

HAMMER WRENCH ASSEMBLY AND METHOD OF USE

BACKGROUND OF THE INVENTION

1. Field of the Invention

The present invention relates to hammer wrenches and, more particularly, to a hammer wrench assembly having an auxiliary safety handle adapted to be rotated up to 180° away from the hammer-end of a hammer wrench.

2. General Background

Conventionally, a user would swing a hammer, with one hand, toward a hammer wrench to hit the hammer-end. The impacts by the hammer provide a strong force to rotate a nut or bolt head engaged by the wrench-end of the hammer wrench so that the nut or bolt head is fastened or unfastened. During such hammering the user, with the other hand, grips a central bar member of the hammer wrench to stabilize the hammer wrench about the nut or bolt head. However, the user's forearm, wrist and gripping hand are at risk of being struck by the hammer, especially if the hammer inadvertently misses the intended hammer-end. Even if the hammer hits the hammer-end, in some instances, after impact, the hammer slips and hits the forearm, hand or wrist of the hand gripping the hammer wrench. Thus, while the hammer wrench is very useful and effective, its use is also a source of many seriously maiming injuries.

Several devices have been patented which are aimed at wrenches with impact surfaces for striking by a hammer or weight.

U.S. Pat. No. 3,799,011, issued to Davis, Jr., entitled "LUG WRENCH," discloses a lug wrench with a handle portion having at one end a ribbed, fluted or knarled rubber or plastic gripping member. At the other end of the handle portion there is a hexagonal socket portion. The lug wrench includes impact arms having impact surfaces for tapping by a hammer. The impact arms, as shown, form acute angles with the handle portion.

U.S. Pat. No. 4,864,902, issued to Doorley, entitled "SOCKET WRENCH SLUGGING DEVICE," discloses a striking tool device comprising a cylindrical metal shaft such as is commonly used as an extension shaft in a socket wrench set. One end of the shaft terminates in a square shank for mating with a socket. The other end of the shaft is a square bore for mating with the drive tang of a ratchet wrench. An arm member is provided that has an anvil-like end portion having striking surfaces for striking by a hammer either in a clockwise or counterclockwise direction. The arm member is coupled about the shaft and is essentially perpendicular to the shaft.

U.S. Pat. Nos. 291,961 and 271,549, issued to True, both entitled "CARRIAGE WRENCH," disclose a handle having a socket at one end. A pair of weights or balls are coupled to the end of a pair of bars radiating from the handle wherein such weights or balls are adapted to be impacted or tapped. U.S. Pat. No. 1,710,198, issued to Torgerson, entitled "SPEED WRENCH," discloses a wrench having a socket coupled to one end of a stock. Heavy weights are coupled to arms wherein the arms radiate from the stock.

U.S. Pat. No. 2,600,796, issued to Nash entitled "IMPACT ATTACHMENT FOR WHEEL LUG WRENCHES," discloses a lug wrench having four radial arms which terminate at one end into a nut socket. The other end of the radial arms terminate together about a grooved hole. An impact arm is adapted to be pivotally coupled in the grooved hole. Furthermore, the impact arm includes a weight and a handle. As can be readily seen, there is a continuing need for a hammer wrench assembly that allows the hammer-end of a conventional hammer wrench to be used for impaction while removing the hand, forearm and wrist from close proximity of the hammer-end as the hammer-end is impacted.

There is a still continuing need for a hammer wrench assembly that includes an safety handle which when used minimizes the risk of injuring the hand, forearm and wrist of a user gripping the hammer wrench as it is impacted with a hammer.

There is still another continuing need for a hammer wrench assembly that can be used by two people without increasing the risk of injury.

As will be seen more fully below, the present invention is substantially different in structure, methodology and approach from that of other wrenches.

SUMMARY OF THE PRESENT INVENTION

The preferred embodiment of the hammer wrench assembly of the present invention solves the aforementioned problems in a straight forward and simple manner.

Broadly, the present invention contemplates a hammer wrench assembly comprising: a hammer wrench having a hammer-end, a wrench-end and a central bar member separating the hammer-end and the wrench-end; and, a rotatable safety handle pivotally coupled to the hammer wrench between the hammer-end and the wrench-end for holding the hammer wrench about a nut as the hammer-end is impacted with a hammer.

The present invention contemplates a method for fastening or unfastening a nut, using a hammer wrench assembly having a hammer wrench with a hammer-end and a wrench-end and a pivotal safety handle pivotally coupleable to the hammer wrench in close proximity to the wrench-end, comprising the steps of: coupling a wrench-end of the hammer wrench about the nut; pivoting the safety handle to a location displaced away from the hammer-end; holding the wrench-end about the nut via the safety handle; simultaneously with the holding step, swinging a hammer to impact the hammer-end; and, rotating the nut with the wrench-end in a direction to fasten or unfasten the nut, in response to the impact to the hammer-end.

In view of the above, an object of the present invention is to provide a hammer wrench assembly and method that is safer to use than prior art hammer wrenches and methods of use thereof.

In view of the above, an object of the present invention is to provide a hammer wrench assembly and method that allows a safety handle to be pivoted to a location within approximately a 180° range.

In view of the above, an object of the present invention is to provide a hammer wrench assembly and method that allows the safety handle to be conveniently and easily pivoted to a location within approximately a 180° range.

In view of the above, an object of the present invention is to provide a hammer wrench assembly and method that allows the use of a safety handle which, in operation, is held by the user such that the hand of the user holding such safety handle is at a safe distance away from the zone of hammering of the hammer wrench.

Another object of the present invention is to provide a hammer wrench assembly and method that allows the hammer wrench assembly to be used by one or two people. In a two user operation, one person swings the hammer while the other person holds the safety handle, to secure the hammer wrench, at a location that is up to 180° away from the hammer-end and the striking hammer.

In view of the above objects, it is a feature of the present invention to provide a hammer wrench assembly that is easy to use.

In view of the above objects, it is a feature of the present invention to, in an alternate embodiment, provide a hammer wrench assembly that can be easily assembled and dissembled.

In view of the above objects, it is a feature of the present invention to, in an alternate embodiment, provide a hammer wrench assembly for which a common tool can be used as the safety handle.

Another feature of the present invention is to provide a hammer wrench assembly that is relatively simple structurally and relies on the design and method of use of a conventional hammer wrench.

A still further object of the present invention is to provide a hammer wrench assembly that minimizes the risk of inadvertent striking of the user or users hand, forearm or wrist during operation.

The above and other objects and features of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

Figures 3, 4, 5:
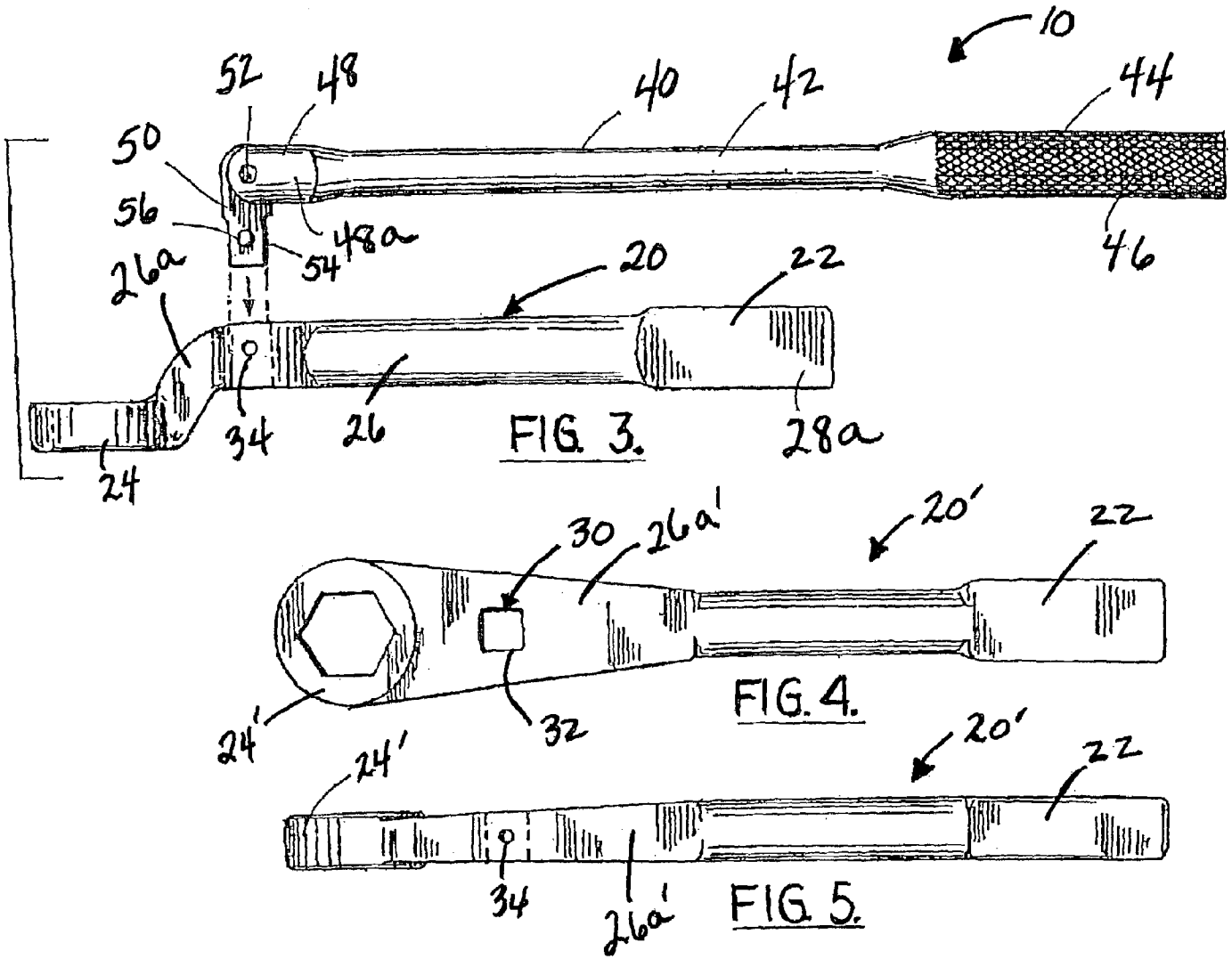
FIG. 3 illustrates an exploded view of the hammer wrench assembly in accordance with the first embodiment of the present invention in FIG. 1.
FIG. 4 illustrates a top plan view of the hammer wrench in accordance with a second embodiment of the present invention.
FIG. 5 illustrates a side plan view of the hammer wrench in accordance with the second embodiment of the present invention in FIG. 4; and, FIG. 6 illustrates a perspective view of the hammer wrench assembly in accordance with the first embodiment present invention in FIG. 3 employed in use.
Figure 6:
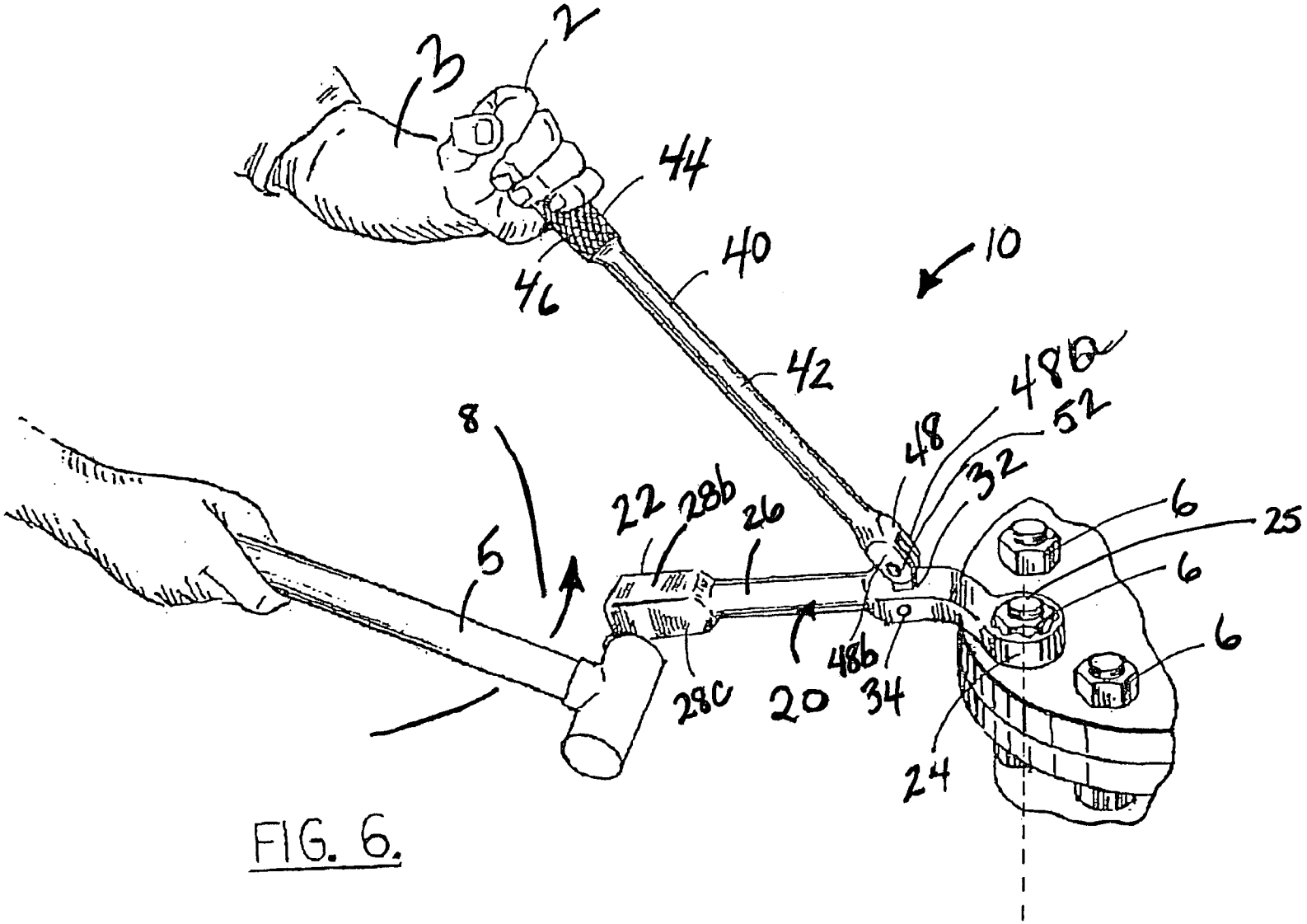

Referring now to the drawings and in particular FIGS. 3 and 6, the hammer wrench assembly of the present invention is generally referenced by the numeral 10. The hammer wrench assembly 10 includes a hammer wrench 20 and a removable safety handle 40 wherein the removable safety handle 40 provides a support for holding the hammer wrench 20 while simultaneously displacing a user's hand from the hammer-end 22 of the hammer wrench 20.

Figure 1:
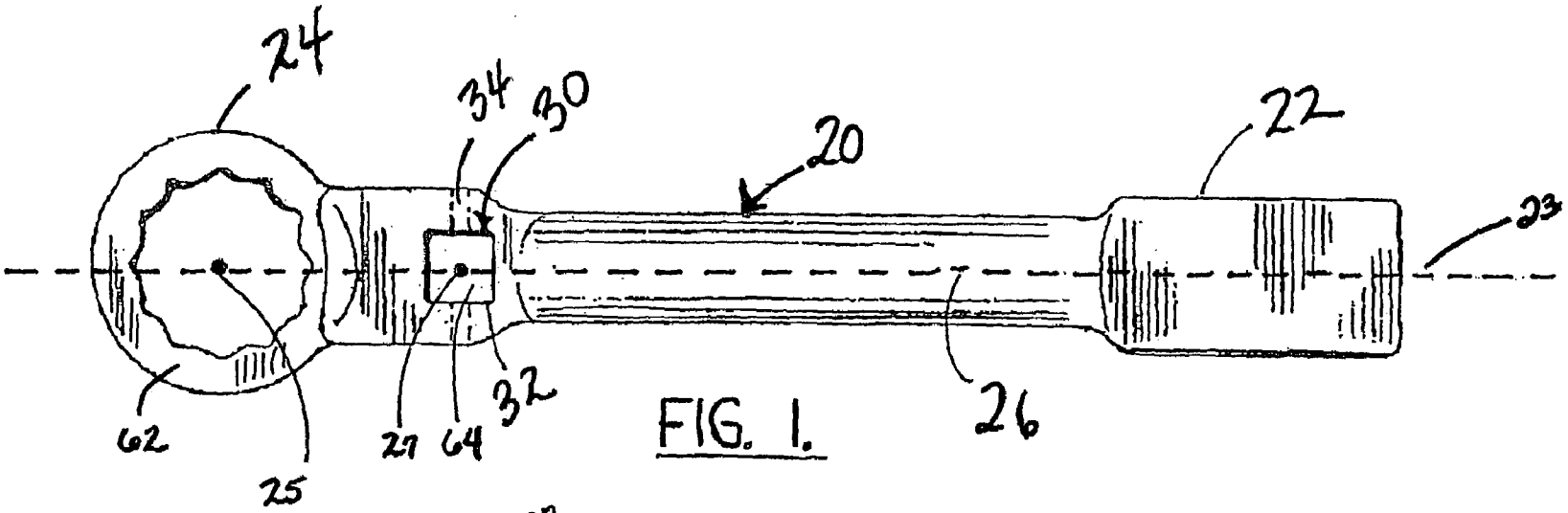
FIG. 1 illustrates a top plan view of the hammer wrench in accordance with a first embodiment of the present invention.
Figure 2:
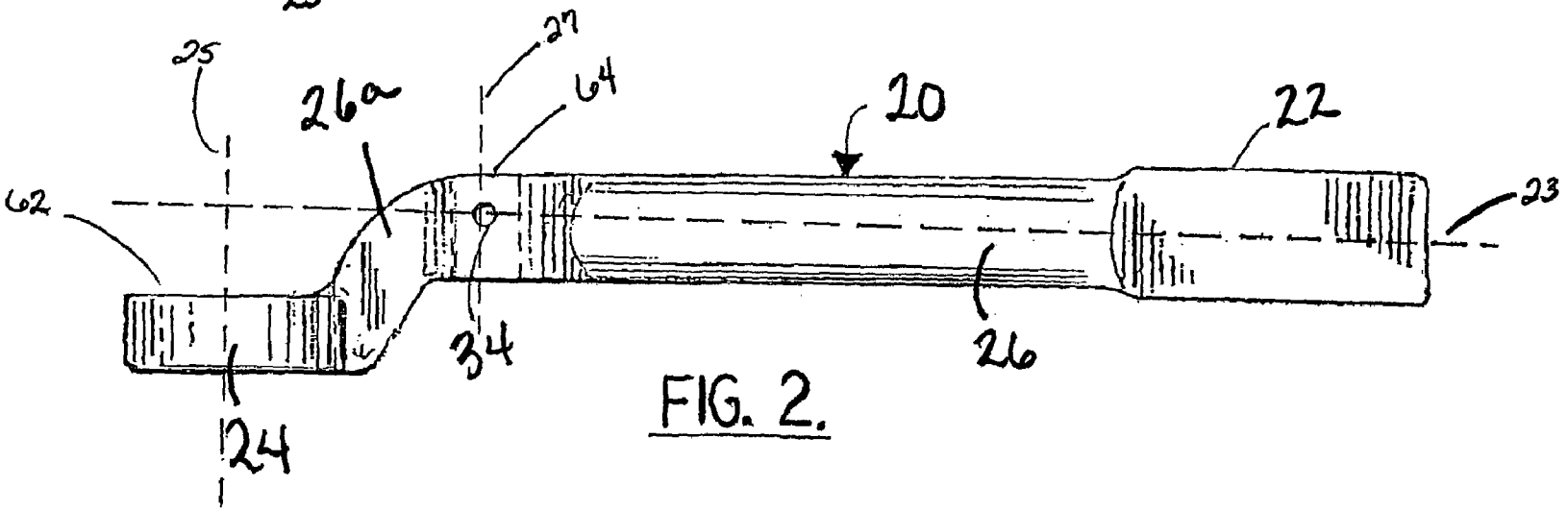
FIG. 2 illustrates a side plan view of the hammer wrench in accordance with the first embodiment of the present invention in FIG. 1.

Referring also to FIGS. 1 and 2, a first embodiment of the hammer wrench 20 is shown. The hammer wrench 20 is similar to a standard (off-the-shelf) hammer wrench having an anvil or hammer-end 22 and a closed wrench (nut socket) or wrench-end 24 in fixed space relation by a central bar member 26. The hammer-end 22 has a generally three-dimensional rectangular shape (although other shapes that could support an anvil-like function could be used for the hammer-end). The three-dimensional rectangular shape provides a plurality of impact surfaces (only three shown) 28*a*, 28*b* and 28*c* (FIGS. 3 and 6) wherein the four sides of the rectangular shape provide four impact surfaces.

The hammer-end 22 is integrally formed with the central bar member 26 and such central bar member 26 has a generally cylindrical shape. Nevertheless, other shapes may be substituted and yet allows for the longitudinal axis of the central bar member 26 to be aligned with a center of the wrench-end 24. Also, a hammer wrench with other configurations of the hammer-end 22 in relation to the wrench-end 24 (such as, but not limited to, where the hammer-end 22 is offset, or at an angle to, the central bar member 26 but yet still supports correct operation in rotating the nut 6 in the wrench-end 24 when impacted by a hammer 5) could also be likewise adapted with the female fitting 30 to achieve, make and practice the invention.

In conventional use, the central bar member 26 is generally cylindrically shaped to provide a gripping surface to hold or steady the hammer wrench 20 about the bolt head or nut 6 to be loosened or tightened. Such conventional use is a first mode of operation of the hammer wrench assembly 10.

The central bar member 26 is fitted with a female fitting 30 positioned closer to the wrench-end 24 than the hammer-end 22 and, in a most preferred embodiment, just below the wrench-end 24. In the exemplary embodiment, the female fitting 30 comprises a generally square bore hole 32 extending through the central bar member 26. In the exemplary embodiment, the bore hole 32 has a center axis that is aligned (essentially parallel and essentially in the same plane) with the center axis 25 of the wrench-end 24, and perpendicular to the longitudinal axis 23 of the central bar member 26. The female fitting 30 further comprises a pair of bore holes 34 penetrating the bore hole 32 for use in locking or securing the safety handle 40 to the hammer wrench 20. Generally, the female fitting 30 should be adapted to accommodate and operate with whatever securing or locking feature is present on the male fitting 50. In the exemplary embodiment, the pair of bore holes 34 have the same center axis which is perpendicular to the center axis 27 of the square bore hole 32 and perpendicular to the longitudinal axis 23 of the central bar member 26. The female fitting 30 may, in lieu of a pair of bore holes 34, have only one of the pair of bore holes 34; and, in such case, the invention would still operate but might be less efficient or convenient.

From a different perspective, the relationship between the wrench-end 24 and the bore hole 32 is such that the wrench-end face 62 (which face 62 is in the plane perpendicular to the center axis 25 of the wrench-end 24) and the mounting face 64 of the bore hole 32 of the female fitting 30 (which mounting face 64 is in the plane perpendicular to the center axis 27 of the bore hole 32) face the same direction, or substantially so. In operation, as best seen in FIG. 6, this arrangement of the wrench-end face 62 and the mounting face 64 serves to advantageously distance the user's arm 3 and hand and fingers 2 from the hammer path or strike zone 8.

In the exemplary embodiment of FIGS. 1 and 2, the wrench-end 24 is sloped or offset from the longitudinal axis of the central bar member 26 via elbow 26*a*. Elbow 26*a* lowers the wrench-end 24 while maintaining the center axis of the wrench-end 24 aligned perpendicular to the longitudinal axis of the central bar member 26. Furthermore, the wrench-end 24 has a multi-sided bore hole or nut socket.

FIGS. 4 and 5 illustrate an alternate embodiment of the hammer wrench 20'. The hammer wrench 20' differs from the hammer wrench 20 of FIGS. 1 and 2 in that the wrench-end 24' has a hexagonal-shaped hole or nut socket. Furthermore, the wrench-end 24' is not sloped or offset from the hammer-end 22' by an elbow. Instead, an adapter 26*a'* is inserted between the end of the central bar member 26 and the wrench-end 24'. Such adapter 26*a'* includes top and bottom surfaces that taper toward the wrench-end 24'.

Referring again to FIGS. 3 and 6, the safety handle 40 is made of metal (like the hammer wrenches 20 and 20') and comprises an elongated central bar member 42 having one end serving as a handle section 44. The handle section 44 has a larger diameter than the diameter of the elongated central bar member 42. Moreover, the handle section 44 has a generally slip-resistant perimeter surface 46.

In the exemplary embodiment, the handle section 44 has score-lines formed therein to create friction between the user's hand 2 and the handle section 44. In an alternate embodiment, the handle section 44 may include a rubber jacket or other applique that creates friction with the user's hand 2. The other end of the elongated central bar member 42 includes a forked-end 48 having two parallel and spaced apart plates 48*a* and 48*b*.

The safety handle 40 further comprises a male fitting 50 that is pivotally coupled to and pivots between plates 48*a* and 48*b* via pivot coupling 52. The male fitting 50 is adapted to mate with the female fitting 30. The male fitting 48 includes a prong 54 adapted to fit in the square bore hole 32 and a spring-biased ball or pin 56 that fits in one of the pair of bore holes 34 to secure the safety handle 40 to the hammer wrench 20. The spring-biased ball or pin 56 can be removed from one of the bore holes 34 so that the hammer wrench assembly 10 can be easily stored or to use the hammer wrench 20 without the safety handle 40.

In a preferred embodiment, the safety handle 40 is a tool which is commonly available and, in a most preferred embodiment, is a tool used with standard socket sets or, at least, used for purposes other than this invention. Thus, in general, the invention includes the idea or concept to use a female fitting 30 which mates with a tool already used by, and in the toolbox of the user, wherein such tool serves as the safety handle 40.

Referring now to FIG. 6, the pivot coupling 52 allows the safety handle 40 to pivot within a 180° range. However, in FIG. 6, the safety handle 40 is shown rotated to one of many angles with respect to the hammer wrench 20. This allows a single user to hold the hammer wrench 20 about nut 6 while swinging the hammer 5 to impact one of the impact surfaces (only three shown) 28*a*, 28*b* and 28*c* of the hammer-end 22.

The advantage of the safety handle 40 is that it moves the user's hand 2, forearm 3 and wrist away from the path or strike zone 8 of the hammer 5 when it is swung just in case the hammer 5 inadvertently misses or glances-off the hammer-end 22. The above described operation is for a single user operation mode.

Referring still to FIG. 6, another advantage of the safety handle 40 is that it can be held by another user without risking injury when the hammer 5 is swung. For very hard-to-loosen or tighten bolt heads or nuts 6, two user operation mode can be used to loosen the bolt head or nut 6 without obstructing or limiting access to the impact surfaces (only three shown) 28*a*, 28*b* and 28*c*. For example, a first user could rotate the elongated central bar member 42 so that the handle section 44 is positioned away from (such as, without limitation 90° to 120°) the hammer-end 22 and stand away from the hammer-end 22 and out of the path needed to swing the hammer 5 when hitting the impact surfaces (only three shown) 28*a*, 28*b* and 28*c*. The two user operation mode also leaves both hands available for gripping and swinging the hammer 5. Accordingly, the hand, forearms and wrists of the two users are not in close proximity of the hammer-end 22 and its impact surfaces. Thus, I speculate, risk of injury is significantly minimized when using the hammer wrench assembly 10.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. An improved hammer wrench comprising:

a hammer-end having a plurality of impact surfaces;

a wrench-end adapted to attach to a bolt head or nut; and, a central bar member with one end integrally formed with the hammer-end, with another end attached to the wrench-end and with a female coupler between the wrench-end and the hammer-end wherein the female coupler is in close proximity to the wrench-end wherein:

said central bar member has a longitudinal axis;

said wrench-end has a center axis perpendicular to the longitudinal axis; and, said female coupler has a center axis perpendicular to the longitudinal axis.

2. An improved hammer wrench comprising:

a hammer wrench with a hammer-end, a wrench-end and a central bar member, said central bar member having a first end, a second end opposite said first end, and a longitudinal axis wherein said hammer-end is integral with said first end and said wrench-end is coupled directly to said second end and has a center axis that is perpendicular to said longitudinal axis; and, a coupling means formed in said central bar member between said hammer-end and said wrench-end for removably coupling a handle to said hammer wrench wherein said coupling means has a center axis perpendicular to said longitudinal axis.

3. The improved hammer wrench of claim 2, wherein said coupling means comprises a female fitting for receiving a mated male fitting attached to said handle.

4. The improved hammer wrench of claim 2, wherein the wrench-end comprises a multi-sided bore hole.

5. A hammer wrench assembly comprising:

a hammer wrench with a hammer-end, a wrench-end and a central bar member, said central bar member having a first end, a second end opposite said first end, and a longitudinal axis wherein said hammer-end is integral with said first end and said wrench-end is coupled directly to said second end and has a center axis that is perpendicular to said longitudinal axis;

a safety holding means for holding said hammer wrench at a safe distance; and, coupling means for removably coupling said safety holding means to said hammer wrench in close proximity to said wrench-end and between said hammer-end and said wrench-end wherein said coupling means has a center axis perpendicular to said longitudinal axis.

6. The assembly of claim 5, wherein said coupling means comprises a receiving means for receiving a mated fitting means attached to said safety holding means.

7. The assembly of claim 6, wherein said receiving means has a mounting face which faces in a same direction as a wrench-end face of the wrench-end.

8. The assembly of claim 5, wherein said safety holding means comprises means for attaching handles for use with socket sets to items in socket sets; and said coupling means comprises a receiving means for receiving said attaching means.

* * * * *